US010704414B2

(12) United States Patent
Jain et al.

(10) Patent No.: US 10,704,414 B2
(45) Date of Patent: Jul. 7, 2020

(54) AIRFOIL CONTAINMENT STRUCTURE INCLUDING A NOTCHED AND TAPERED INNER SHELL

(71) Applicant: General Electric Company, Schenectady, NY (US)

(72) Inventors: Nitesh Jain, Karnataka (IN); Nicholas Joseph Kray, Mason, OH (US); Manoj Kumar Jain, Karnataka (IN); Mojibur Rahman, Mason, OH (US); Nagamohan Govinahalli Prabhakar, Karnataka (IN); Scott Roger Finn, Montgomery, OH (US); Thomas Chadwick Waldman, Boston, MA (US); Apostolos Pavlos Karafillis, Winchester, MA (US)

(73) Assignee: General Electric Company, Schenectady, NY (US)

( * ) Notice: Subject to any disclaimer, the term of this patent is extended or adjusted under 35 U.S.C. 154(b) by 413 days.

(21) Appl. No.: 15/455,710

(22) Filed: Mar. 10, 2017

(65) Prior Publication Data

US 2018/0258796 A1 Sep. 13, 2018

(51) Int. Cl.
*F01D 21/04* (2006.01)

(52) U.S. Cl.
CPC ..... *F01D 21/045* (2013.01); *F05D 2220/36* (2013.01); *F05D 2230/10* (2013.01); *F05D 2230/11* (2013.01); *F05D 2230/13* (2013.01); *F05D 2230/14* (2013.01); *F05D 2230/40* (2013.01); *F05D 2250/182* (2013.01); *F05D 2250/292* (2013.01); *F05D 2250/293* (2013.01); *F05D 2250/294* (2013.01)

(58) Field of Classification Search
CPC ..... F01D 21/045; F04D 29/526
See application file for complete search history.

(56) References Cited

U.S. PATENT DOCUMENTS

| | | | | |
|---|---|---|---|---|
| 4,509,616 | A * | 4/1985 | Blecherman | F01D 25/243 181/214 |
| 4,534,698 | A * | 8/1985 | Tomich | F01D 21/045 415/121.2 |
| 5,273,393 | A | 12/1993 | Jones et al. | |
| 5,723,831 | A | 3/1998 | Martin et al. | |
| 6,082,959 | A * | 7/2000 | Van Duyn | F01D 21/045 415/173.4 |
| 6,123,170 | A | 9/2000 | Porte et al. | |
| 6,240,719 | B1 | 6/2001 | Vondrell et al. | |

(Continued)

FOREIGN PATENT DOCUMENTS

JP 2000210763 A * 8/2000

*Primary Examiner* — Moshe Wilensky
*Assistant Examiner* — Topaz L. Elliott
(74) *Attorney, Agent, or Firm* — Hanley, Flight and Zimmerman, LLC

(57) ABSTRACT

A containment structure for surrounding a rotatable machine includes a double-walled inner shell having a forward end, an aft end, and a substantially cylindrical body extending therebetween. The inner shell includes an inner wall at least partially surrounding a bladed portion of the bladed rotor, and an outer portion that branches radially outward from the inner wall. The containment structure also includes a substantially cylindrical back sheet coupled to the outer portion and disposed radially outward of the inner wall.

23 Claims, 3 Drawing Sheets

(56) References Cited

U.S. PATENT DOCUMENTS

| | | | | |
|---|---|---|---|---|
| 6,325,546 | B1 | 12/2001 | Storace | |
| 6,382,905 | B1 | 5/2002 | Czachor et al. | |
| 6,619,913 | B2 * | 9/2003 | Czachor | F01D 21/045 415/119 |
| 7,407,369 | B2 | 8/2008 | Schwarz et al. | |
| 7,503,425 | B2 | 3/2009 | Strunk | |
| 8,371,803 | B2 | 2/2013 | Evans | |
| 8,966,754 | B2 | 3/2015 | Xie | |
| 8,986,797 | B2 | 3/2015 | Xie | |
| 9,080,461 | B2 | 7/2015 | Ivakitch et al. | |
| 9,249,681 | B2 | 2/2016 | Robertson, Jr. et al. | |
| 10,024,191 | B2 * | 7/2018 | Totten | F01D 25/24 |
| 2008/0199301 | A1 | 8/2008 | Cardarella, Jr. | |
| 2009/0214327 | A1 * | 8/2009 | Evans | F01D 21/045 415/9 |
| 2011/0081227 | A1 * | 4/2011 | McMillan | F01D 21/045 415/9 |
| 2012/0034076 | A1 * | 2/2012 | Xie | F01D 21/045 415/200 |
| 2015/0275695 | A1 * | 10/2015 | Evans | F01D 25/243 415/9 |
| 2017/0335862 | A1 * | 11/2017 | Heeter | F04D 29/325 |
| 2018/0266271 | A1 * | 9/2018 | Scott | F01D 21/045 |

* cited by examiner

AIRFOIL CONTAINMENT STRUCTURE INCLUDING A NOTCHED AND TAPERED INNER SHELL

BACKGROUND

The subject matter disclosed herein relates to containment structures and, more particularly, to an airfoil containment structure that includes a notched and tapered inner shell.

Gas turbine engines, and particularly turbofan engines used in aircraft, have a fan with a hub and a plurality of fan blades disposed for rotation about a central axis. It is common to include a generally cylindrical fan case about a periphery of the fan for containing objects, such as the fan blade.

For smaller diameter engines, adequate containment capability may be achieved with a metallic, hard-wall, case. However, for larger diameter engines, "soft-wall" containment systems may be used.

In soft-wall systems, a lightweight, high strength ballistic fabric is wrapped in multiple layers around a relatively thin support structure. Conventional support structures may be fabricated of aluminum based on weight considerations. The support structure may include aluminum honeycomb structures.

BRIEF DESCRIPTION

In one aspect, a containment structure for surrounding a rotatable machine comprising a bladed rotor is provided. The containment structure includes a double-walled inner shell having a forward end, an aft end, and a substantially cylindrical body extending therebetween. The inner shell includes an inner wall at least partially surrounding a bladed portion of the bladed rotor, and an outer portion that branches radially outward from the inner wall. The containment structure also includes a substantially cylindrical back sheet coupled to the outer portion and disposed radially outward of the inner wall.

In another aspect, a turbofan jet engine is provided. The turbofan jet engine includes a fan assembly, which includes a rotor, and a plurality of fan blades coupled to the rotor and extending radially outward from the rotor. The turbofan jet engine also includes a cylindrical containment structure disposed circumferentially about the fan assembly. The containment structure includes a double-walled inner shell having a forward end, an aft end, and a substantially cylindrical body extending therebetween. The inner shell includes an inner wall at least partially surrounding a bladed portion of the bladed rotor, and an outer portion that branches radially outward from the inner wall. The containment structure also includes a substantially cylindrical back sheet coupled to the outer portion and disposed radially outward of the inner wall.

In yet another aspect, a containment structure is provided. The containment structure includes a first wall comprising a first end, a second end, and a first body extending therebetween, and a fuse area extending along a surface of the first body.

DRAWINGS

These and other features, aspects, and advantages of the present disclosure will become better understood when the following detailed description is read with reference to the accompanying drawings in which like characters represent like parts throughout the drawings, wherein.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about" and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

Embodiments of the present disclosure relate to a fan blade containment structure, such as a fan case, that includes an inner shell having an inner wall and an outer portion that branches radially outward from the inner wall at a fillet. The fan case is configured to guide a rupture or crack occurring in the inner shell as a result of a fan blade out (FBO) event, such that the rupture travels circumferentially within the inner shell as opposed to aft within the inner shell. To this end, the inner shell includes a plurality of axially spaced notches or grooves, which function to draw a rupture occurring within the inner shell circumferentially. The confluence of the inner wall and the outer portion at the fillet is also reinforced to prevent expansion or propagation of the rupture aft of the fillet.

Figure 1:
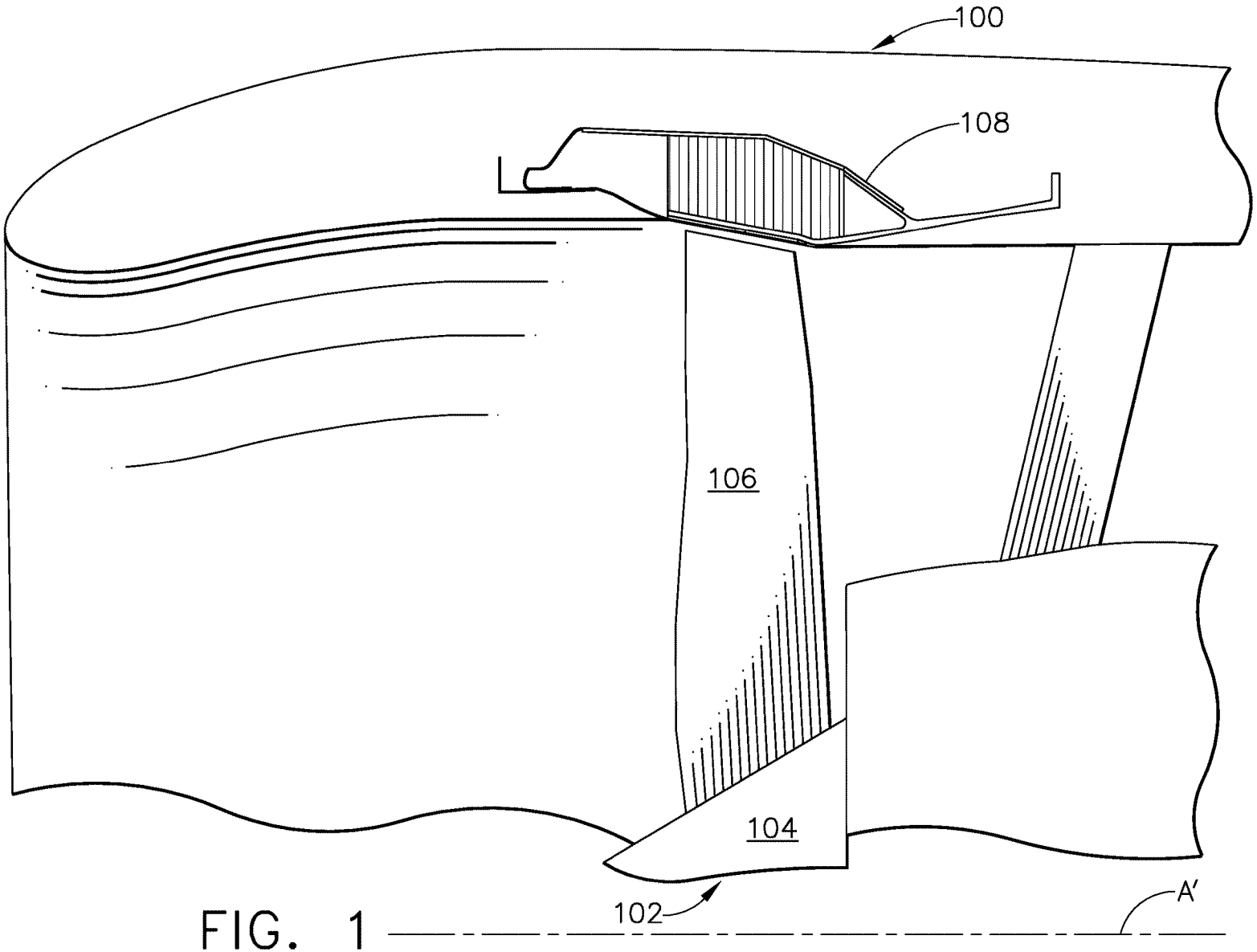
FIG. 1 is a cross-sectional view of a forward portion of a turbofan engine showing an exemplary fan blade containment structure that includes a notched and tapered inner shell.

FIG. 1 is a cross-sectional view of a forward portion of a turbofan engine 100. Turbofan engine 100 includes a fan assembly 102 having a rotor 104 and an array of fan blades 106 extending radially outward from rotor 104. A cylindrical soft-wall containment system, or blade containment structure, such as a fan case 108, is disposed radially about the periphery of the fan assembly 102. As shown, fan case 108 extends forward to aft along a central axis A-A'. In the exemplary embodiment, and as described in greater detail below, fan case 108 is configured to contain fan blade fragments thrown into fan case 108 during a fan blade out (FBO) event.

Figure 2:
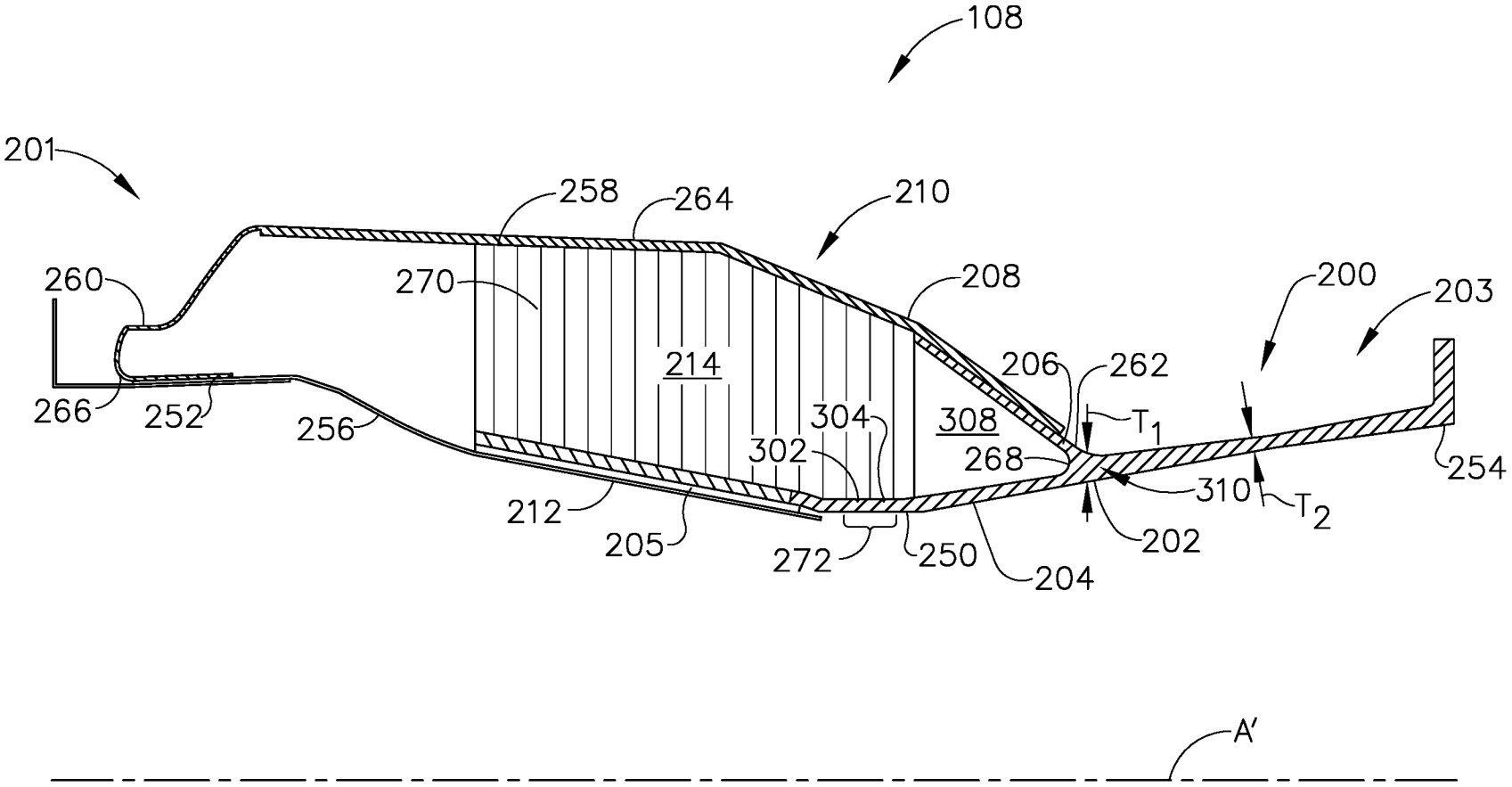
FIG. 2 is a cross-sectional view of the fan blade containment structure of FIG. 1.

FIG. 2 is a cross-sectional view of an aft portion of fan case 108. For clarity, flanges and other design specific details of fan case 108 are omitted. It will be understood that fan case 108 may assume various shapes and may include various design specific details based upon the turbofan engine within which fan case 108 is mounted. For instance, the attachment mechanisms used to mount fan case within a particular turbofan engine may vary substantially and are not essential to an understanding of the present disclosure.

Accordingly, and as shown, fan case 108 includes a double-walled metallic inner shell 200 that branches at a fillet 202 between an inner wall 204 and an outer portion 206. Inner shell 200 extends along central axis A-A' and has a forward end 201 and an aft end 203. A back sheet 208 is coupled to outer portion 206 and extends forward to define an outer surface 210 of fan case 108. In the exemplary embodiment, back sheet 208 is manufactured from a composite carbon fiber. In other embodiments, back sheet 208 is metallic.

An ablative plate 212 and an acoustic structure 214, such as a honeycomb structure, are installed within fan case 108. Specifically, ablative plate 212 is disposed within or coupled to an outer surface 205 of inner shell 200, and acoustic structure 214 is mounted between inner shell 200 and back sheet 208. As described in greater detail below, inner wall 204 may function as a primary load path, while outer portion 206 in conjunction with back sheet 208 may function as a secondary, or backup, load path.

Figure 4:
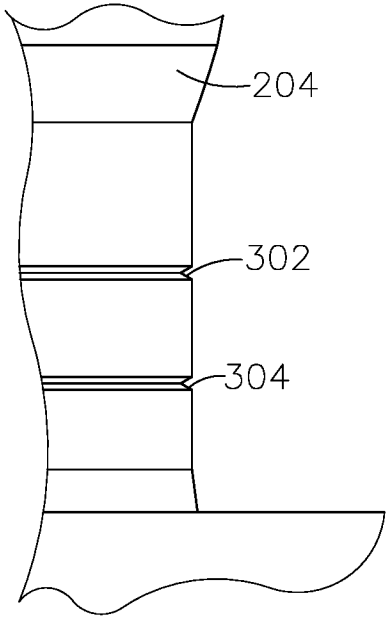
FIG. 4 is a cutaway view of the notched and tapered inner shell shown at FIG. 3.
Figure 3:
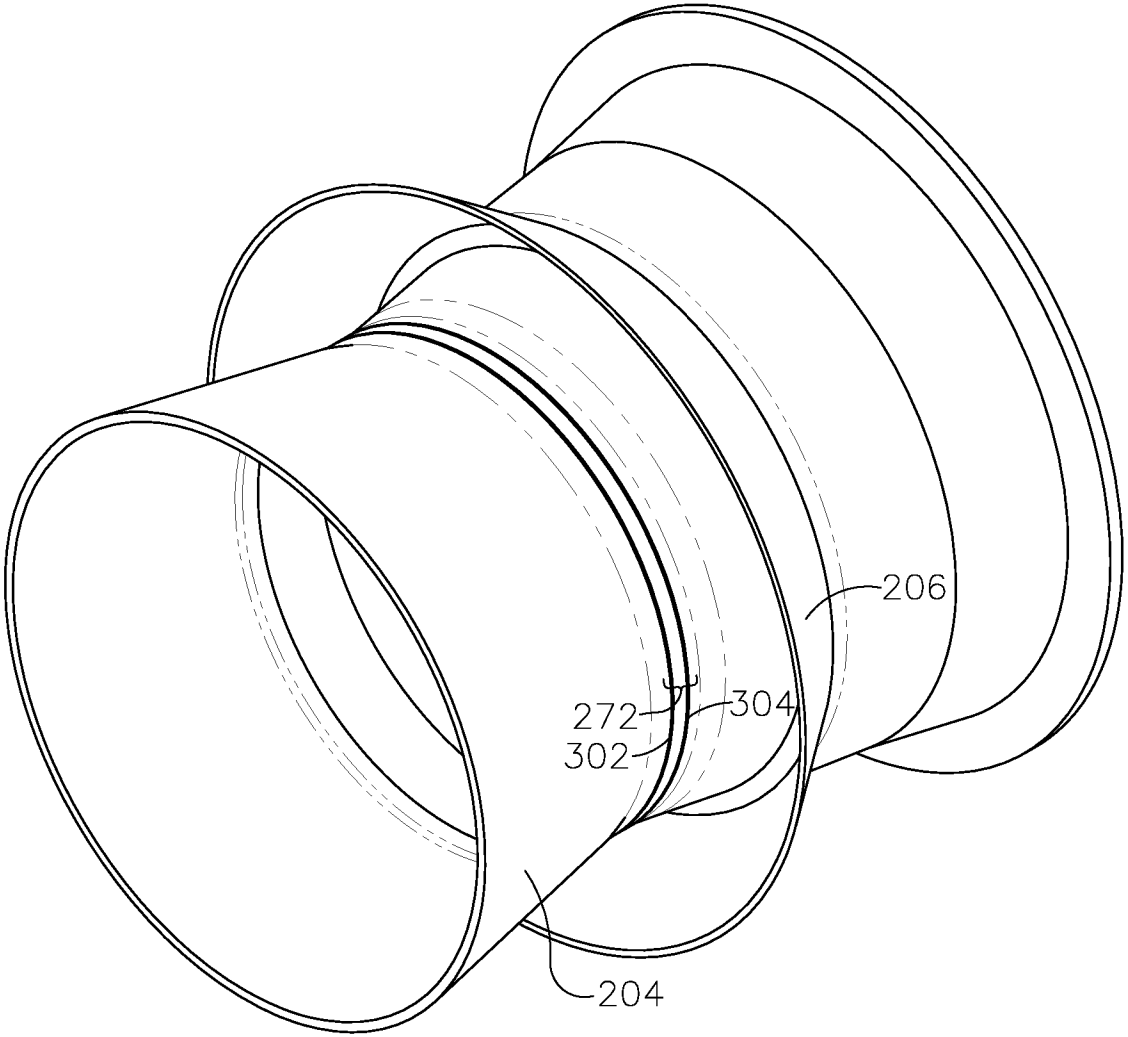
FIG. 3 is a perspective view of an exemplary notched and tapered inner shell of the fan blade containment structure of FIG. 2.

FIG. 3 is a perspective view of an exemplary inner shell 200 of fan case 108. FIG. 4 is a cutaway view of inner shell 200. With combined reference to FIGS. 2, 3, and 4, inner shell 200 includes a plurality of circumferential depressions or notches, such as notches 302 and 304. Although two notches 302 and 304 are shown, in alternative embodiments, any suitable number of notches may be incorporated in inner shell 200.

Notches 302 and 304 extend circumferentially about an inner surface 306 of inner wall 204 of inner shell 200. In addition, notches 302 and 304 are formed forward of fillet 202 and aft of ablative plate 212, such that notches 302 and 304 are not disposed directly over fan blades 106. Rather, in the exemplary embodiment, notches 302 and 304 are disposed under acoustic structure 214 to take advantage of a cushioning or vibration dampening effect of acoustic structure 214. However, in an alternative embodiment, notches 302 and 304 are disposed aft of acoustic structure 214, such that they are not under acoustic structure 214 but within a Y-shaped region 308 defined between inner wall 204 and outer portion 206 of inner shell 200.

Notches 302 and 304 may be any fuse area, such as any fuse area in which inner shell 200 is treated or weakened or in which the thickness of inner shell 200 is reduced. For example, notches 302 and 304 may be any fuse area treated with at least one of a mechanical treatment, a chemical treatment, and a directed energy treatment. In various embodiments, mechanical treatments may include peened areas and the like. Similarly, chemical treatments may include acid masks, acid stripping, and the like. In addition, in various embodiments, directed energy treatment may include laser treatments, radiation treatments, heat treatments, and the like.

In addition, notches 302 and 304 may be depressions, perforations, holes, slots, indentations, channels, troughs, and the like. Notches 302 and 304 are formed in inner shell 200 by any suitable means. For example, notches 302 and 304 may be stamped, punched, pressed, scored, welded, machined, lasered, and the like, in inner shell 200. In some embodiments, the structure of inner shell 200 is changed to form notches 302 and 304. For example, the structure of inner shell 200 may be altered or weakened by the application of heat, by a chemical process, by mechanical percussion, by the application of a laser to inner shell 200, and the like.

Further, in some embodiments, notches 302 and/or 304 include one or more energy dissipation areas, which may be introduced at intervals along notches 302 and/or 304. These energy dissipation areas may be holes or apertures formed within notches 302 and/or 304, and may function to dissipate the energy associated with a crack propagating (as described herein) along notches 302 and/or 304, such that the crack does not continue to propagate beyond an energy dissipation area once the energy dissipation area is encountered by the crack.

With continuing reference to FIG. 3, inner shell 200 is reinforced aft of fillet 202 within a region 310 of inner shell 200. For example, inner shell 200 tapers within region 310 from a first thickness, T1, to a second, reduced, thickness, T2, as inner shell 200 extends aft within region 310. Thus, inner shell 200 tapers within region 310, from forward to aft, such that the thickness of inner shell 200 decreases from T1 to T2 within region 310.

In some embodiments, inner shell 200 includes a first wall 250 (e.g., such as inner wall 204) that has a first end 252, a second end 254, and a first body 256 that extends between first end 252 and second end 254. Inner shell 200 also includes a second wall 258 (e.g., such as outer portion 206 coupled to back sheet 208) that has a third end 260, a fourth end 262, and a second body 264 that extends between third end 260 and fourth end 262. Third end 260 is coupled to first body 256 at a first joint 266, and fourth end 262 is coupled to first body 256 at a second joint 268. Second joint 268 is spaced from first joint 266 and forms a cavity 270 between first wall 250 and second wall 258. In addition, a fuse area 272 (e.g., notches 302 and 304) extends along a surface (e.g., inner surface 306) of first body 256 in a direction that is approximately parallel to first joint 266 and/or second joint 268.

In operation, and during an FBO event, a fragment of one of fan blades 106 may break off and strike inner wall 204 of inner shell 200. As a result, inner wall 204 of inner shell 200 may be damaged, such as a by a crack, rupture, or tear within inner wall 204.

In the exemplary embodiment, damage resulting from an FBO event is encouraged to remain within inner wall 204 by notches 302 and 304. For example, a rupture in inner wall 204 of inner shell 200 may propagate aft within inner wall 204 of inner shell 200 until the rupture encounters one or both of notches 302 and/or 304, at which point the rupture is diverted from expanding radially outwards, through acoustic structure 214, into back sheet 208. Rather, as the rupture encounters one or both of notches 302 and/or 304, the rupture meets with a loss of structural integrity in notches 302 and/or 304 and is guided circumferentially (or driven circumferentially) through notches 302 and/or 304 within inner wall 204 of inner shell 200, such that back sheet 208 is preserved from damage.

In addition, damage that is able to propagate from inner wall 204 of inner shell 200, through acoustic structure 214, and into back sheet 208 is prevented from expanding aft within back sheet 208. Rather, the rupture follows the rupture in inner wall 204 of inner shell 200 circumferentially as a result of the momentum imparted by the rupture in inner wall 204. Thus, even where a rupture is able to propagate into back sheet 208, the damage may be guided circumferentially within back sheet 208 as it is pulled along by the momentum of the rupture within inner wall 204 of inner shell 200.

In some embodiments, one or circumferentially spaced notches or grooves may be included on inner shell 200. In particular, one or more circumferentially spaced notches or grooves may extend axially over an inner surface 306 of inner wall 204 of inner shell 200. These notches or grooves may function to draw a crack or rupture aft, rather than circumferentially, as described above with respect to notches 302 and 304. Thus, in various embodiments, notches or grooves may run circumferentially and/or axially along inner shell 200, such that a rupture may be guided either or both of aft and/or circumferentially.

In addition, reinforced region 310 of inner shell 200 acts to prevent continued expansion of the rupture through region 310. Moreover, as described above, outer portion 206 of inner shell and back sheet 208 work in conjunction to form a secondary, or backup, load path, which functions to preserve the structural integrity of fan case 108 in the event that inner wall 204 of inner shell 200 is damaged and unable to function as the primary load path within fan case 108. Thus, fan case 108 is able to remain structurally intact even in the event that inner wall 204 of inner shell 200 experiences structural failure.

Embodiments of the fan blade containment structure therefore include an inner shell having an inner wall and an outer portion that branches radially outward from the inner wall at a fillet. The fan blade containment structure is configured to guide a rupture or crack occurring in the inner shell as a result of a fan blade out (FBO) event, such that the rupture travels circumferentially within the inner shell as opposed to aft within the inner shell. To this end, the inner shell includes a plurality of axially spaced notches or grooves, which function to draw a rupture occurring within the inner shell circumferentially. The confluence of the inner wall and the outer portion at the fillet is also reinforced to prevent expansion of the rupture aft of the fillet.

Exemplary embodiments of a fan blade containment structure and related components are described above in detail. The system is not limited to the specific embodiments described herein, but rather, components of systems and/or steps of the methods may be utilized independently and separately from other components and/or steps described herein. For example, the configuration of components described herein may also be used in combination with other processes, and is not limited to practice with the systems and related methods as described herein. Rather, the exemplary embodiment can be implemented and utilized in connection with many applications where fan blade containment is desired.

Although specific features of various embodiments of the present disclosure may be shown in some drawings and not in others, this is for convenience only. In accordance with the principles of the present disclosure, any feature of a drawing may be referenced and/or claimed in combination with any feature of any other drawing.

This written description uses examples to disclose the embodiments of the present disclosure, including the best mode, and also to enable any person skilled in the art to practice the disclosure, including making and using any devices or systems and performing any incorporated methods. The patentable scope of the embodiments described herein is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A fan blade containment structure for a rotatable machine including a bladed rotor, said containment structure comprising:

a double-walled inner shell having a forward end, an aft end, and a substantially cylindrical body extending therebetween, said inner shell including:

an inner wall at least partially surrounding a bladed portion of said bladed rotor, said inner wall including a first circumferential notch; and an outer portion that branches radially outward from said inner wall; and a substantially cylindrical back sheet coupled to said outer portion and disposed radially outward of said inner wall.

2. The fan blade containment structure of claim 1, wherein said outer portion branches radially outward from said inner wall at a fillet reinforced to halt propagation of a rupture in said inner wall.

3. The fan blade containment structure of claim 2, wherein said inner wall tapers in thickness aft of said fillet.

4. The fan blade containment structure of claim 2 further comprising an ablative plate disposed within an outer surface of said inner wall, and wherein said first circumferential notch is disposed within an inner surface of said inner wall axially aft of said ablative plate and axially forward of said reinforced fillet.

5. The fan blade containment structure of claim 1, wherein said inner wall comprises a treated area, having less material strength than an untreated area of said inner wall, said treated area treated with at least one of a mechanical treatment, a chemical treatment, and a directed energy treatment.

6. The fan blade containment structure of claim 5, wherein said mechanical treatment includes the first circumferential notch and a second circumferential notch.

7. The fan blade containment structure of claim 5, wherein said chemical treatment includes at least one of an acid mask and acid stripping.

8. The fan blade containment structure of claim 5, wherein said directed energy treatment includes at least one of a laser treatment, a radiation treatment, and a heat treatment.

9. The fan blade containment structure of claim 5, wherein said treated area includes the first circumferential notch and a second circumferential notch, wherein said first circumferential notch is spaced axially forward of said second circumferential notch.

10. The fan blade containment structure of claim 1, wherein said first circumferential notch is configured to weaken a structural integrity of said inner wall of said inner shell, such that a rupture in said inner wall of said inner shell is prevented from expanding aft within said inner wall of said inner shell.

11. The fan blade containment structure of claim 1, wherein said first circumferential notch is configured to weaken a structural integrity of said inner wall of said inner shell, such that a rupture in said inner wall of said inner shell is drawn circumferentially about said inner wall.

12. The fan blade containment structure of claim 1, wherein said outer portion of said inner shell and said back sheet define a secondary load path and are together configured to support said fan blade containment structure if said inner wall of said inner shell is damaged.

13. The fan blade containment structure of claim 1 further comprising an acoustic structure disposed between said inner wall and said back sheet.

14. A turbofan jet engine comprising:

a fan assembly including a rotor; and:

a double-walled inner shell having a forward end, an aft end, and a substantially cylindrical body extending therebetween, said inner shell including:

an inner wall at least partially surrounding said rotor, said inner wall including a fuse area having a first circumferential notch; and an outer portion that branches radially outward from said inner wall; and a substantially cylindrical back sheet coupled to said outer portion and disposed radially outward of said inner wall.

15. The turbofan jet engine of claim 14, wherein said outer portion branches radially outward from said inner wall at a joint reinforced to resist propagation of a rupture in said inner wall.

16. The turbofan jet engine of claim 15, wherein said inner wall tapers in thickness aft of said joint.

17. The turbofan jet engine of claim 15 further comprising an ablative plate disposed within an outer surface of said inner wall, and wherein said first circumferential notch is disposed within an inner surface of said inner wall axially aft of said ablative plate and axially forward of said joint.

18. The turbofan jet engine of claim 14, wherein said inner wall comprises a mechanical treatment, said mechanical treatment including said first circumferential notch and a second circumferential notch.

19. The turbofan jet engine of claim 18, wherein said first circumferential notch is spaced axially forward of said second circumferential notch.

20. The turbofan jet engine of claim 14, wherein said first circumferential notch is configured to weaken a structural integrity of said inner wall of said inner shell, such that a rupture in said inner wall of said inner shell is prevented from expanding aft within said inner wall of said inner shell.

21. The turbofan jet engine of claim 14, wherein:

the inner wall includes a first end, a second end, and a first body extending therebetween; and the fuse area extends along a surface of said first body, said first body comprising a first material strength, said fuse area comprising an area within said first body having a second material strength, said second material strength being weaker than said first material strength.

22. The turbofan jet engine of claim 21, wherein:

the outer portion includes a third end, a fourth end, and a second body extending therebetween, said third end coupled to said first body at a first joint, and said fourth end coupled to said first body at a second joint, said second joint spaced from said first joint forming a cavity between said inner wall and said outer portion.

23. The turbofan jet engine of claim 22, wherein said fuse area extends in a direction approximately parallel to said first and second joints.

* * * * *